US006105854A

United States Patent [19]

Spivey et al.

[11] Patent Number: 6,105,854

[45] Date of Patent: Aug. 22, 2000

[54] CARTON WITH DISPENSING FEATURE

[75] Inventors: Raymond Rudolph Spivey, Mableton, Ga.; Leonard Michael Cooper, West Monroe, La.

[73] Assignee: Riverwood International Corporation, Atlanta, Ga.

[21] Appl. No.: 09/442,049

[22] Filed: Nov. 16, 1999

[51] Int. Cl.[7] ..... B65D 5/72

[52] U.S. Cl. ..... 229/122.1; 229/122; 229/157

[58] Field of Search ..... 229/122, 122.1, 229/156, 157; 206/427; 221/305

[56] References Cited

U.S. PATENT DOCUMENTS

| | | | |
|---|---|---|---|
| 2,568,725 | 9/1951 | Fey | 229/122 |
| 2,868,431 | 1/1959 | Painter | 206/427 |
| 3,356,279 | 12/1967 | Root | 206/427 |
| 4,396,143 | 8/1983 | Killy | 229/122.1 |
| 4,602,735 | 7/1986 | Aaron | 229/122.1 |
| 5,813,597 | 9/1998 | Wakevainen | 229/122 |

FOREIGN PATENT DOCUMENTS

| | | | |
|---|---|---|---|
| 2234495 | 2/1991 | United Kingdom | 229/122.1 |

*Primary Examiner*—Gary E. Elkins

[57] ABSTRACT

An enclosed carton comprising a dispenser in one end of the carton that can be easily opened and closed without tearing the paperboard, the dispenser having a dispensing flap joined at its inner edge to the end of the bottom panel, with the dispensing flap being attached at its side to the side exiting panels of the carton by gusset straps, with the outer edge of the dispensing flap being tucked beneath the bottom edges of side exiting end flaps when the carton is closed, with the dispensing flap having a holding flap recessed in its outer edge for engaging a holding tab on the bottom edges of the side exiting flap.

12 Claims, 3 Drawing Sheets

CARTON WITH DISPENSING FEATURE

BACKGROUND OF THE INVENTION

1. Field of the Invention

The present invention relates generally to an enclosed paperboard carton capable of enclosing containers, which carton has a unique opening and dispensing feature that allows the containers, for example, cans or bottles, to be rolled out from within the carton without destroying the structural integrity of the carton.

2. Background

Fully enclosed cartons capable of enclosing cans have been used in the past that have a feature for dispensing the cans one at a time. Dispenser sections have been provided at various locations within these cartons depending upon the design. Many of these dispensers suffer from the disadvantage that once opened, they cannot be securely closed. In addition, many of these dispensers once opened, tend to let all the containers roll out. Most of these dispensers have been designed for dispensing cans or bottles which have cylindrical tops and bottoms of substantially the same size and configuration. These dispensers are not suitable for dispensing bottles that have a neck of smaller diameter than the body of the bottle.

3. Prior Art

U.S. Pat. No. 3,265,283 to Farquhar discloses a fully enclosed carton having a dispenser for dispensing the enclosed cans. The end wall of the carton has a dispensing flap which can be folded down upon opening. An aperture formed by the flap extends into the side walls to permit grasping of the can to withdraw it from the carton. When the flap is opened, the cans are held in the carton by a arcuate flap portion extending downwardly in the end wall into the center of the aperture. Two tabs are provided at the bottom of the aperture to assist in holding an exiting can in position. One disadvantage of this dispensing feature is that the dispensing flap cannot be securely closed once it is opened. This makes closing the carton after the removal of a can somewhat problematic in that the enclosed cans may not be firmly retained when the carton is stored in certain positions because the flap cannot be secured to the carton after it has been opened. The cans are likely to tumble out of the carton when the carton is shifted to different positions. It will be realized that the design of this carton is not satisfactory for dispensing bottles with necks as the exiting container being dispensed needs to have a corresponding cylindrical top and bottom of approximately the same size to facilitate easy dispensing by a person grasping the ends of the exiting container.

U.S. Pat. No. 4,364,509 to Holley. Jr. et al. also discloses a fully enclosed carton with a dispenser in one of the end walls. This dispenser is likewise formed in the end wall by tearing out an end flap and lowering it into proper position. Expansion slits are provided in the side wall for the user's fingers to grasp the ends of the exiting can. As in the case of the cartons disclosed in the Farquhar patent, this dispenser cannot be securely closed once it has been opened and is not adapted for use with bottles.

SUMMARY OF THE INVENTION

Briefly described, in a preferred form, the objects of this invention are achieved by providing an enclosed carton that has a unique dispenser in the exiting end of the carton. Unlike most of the dispensers in the prior art, this dispenser can be easily opened and closed without tearing the paperboard. The carton is generally rectangular and has a bottom, a top, two sides, a closed end and an exiting end. The carton is foldably constructed from a blank having panels and flaps. The exiting end of the carton permits containers to be taken from the carton via the dispenser.

This carton has a dispensing flap that is joined at its inner edge to the exiting end of the bottom panel. The dispensing flap is attached at its sides to the side panels of the carton by gusset straps. A pair of side exiting end flaps are joined at the exiting end of the carton for holding the dispensing flap in the closed position. The outer edge of the dispensing flap is tucked beneath the bottom edges of the side exiting end flaps when the carton is closed. The distance between the inner edge of the dispensing flap and the bottom edges of the side exiting end flaps is slightly less than the diameter of the containers, so as to hold an exiting container adjacent the dispensing flap in a secure position when the dispensing flap is lowered until the ends of the container are grasped and the container removed.

In its preferred form, the dispensing flap has a holding flap recessed in its outer edge for engaging a holding tab on the bottom edges of the side exiting end flaps. Two finger apertures may be provided in the side panels to permit a person to grasp the ends of the exiting container to facilitate its removal through the exiting end of the carton.

The gusset straps facilitate holding the dispensing flap in a closed position and contribute to the structural integrity of the carton. This carton can be constructed by gluing, taping, stapling and the like, or by locking. One of the unique features of this carton is found in its means for closing the dispensing flap after a container has been removed. Two holding tabs are provided in the bottom edges of the exiting end flaps for holding the recessed holding flap formed in the outer edge of the dispensing flap in the closed position. This holding flap is configured so that it can be placed behind the holding tabs upon closing, and yet be easily disengaged for opening the dispensing flap.

These and other objects, features, and advantages of the present invention will become more apparent upon reading the following specification in conjunction with the accompanying drawing figures.

DETAILED DESCRIPTION OF THE PREFERRED EMBODIMENTS

Figure 2:
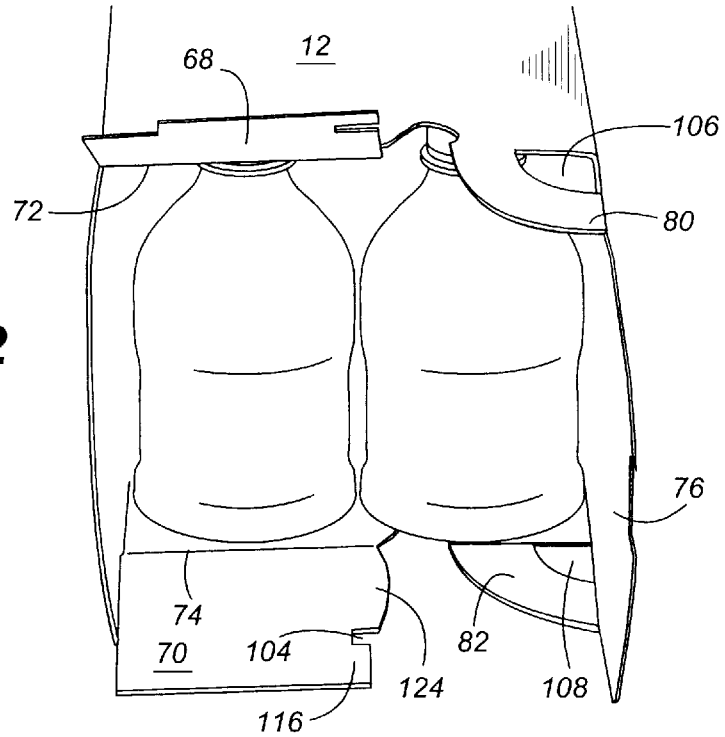
FIG. 2 is perspective end view of the carton with the PET bottles loaded.

The present invention is intended primarily for use with cans and bottles of the types used to contain soft drinks, beer and the like. It is particularly applicable to plastic bottles constructed of polyethylene terephthalate (PET). A conventional PET bottle for use with this invention typically has a short neck and is stubby in appearance, as illustrated in FIG. 2. A can or bottle to be removed from the carton is termed herein as the exiting can or bottle.

Figure 1:
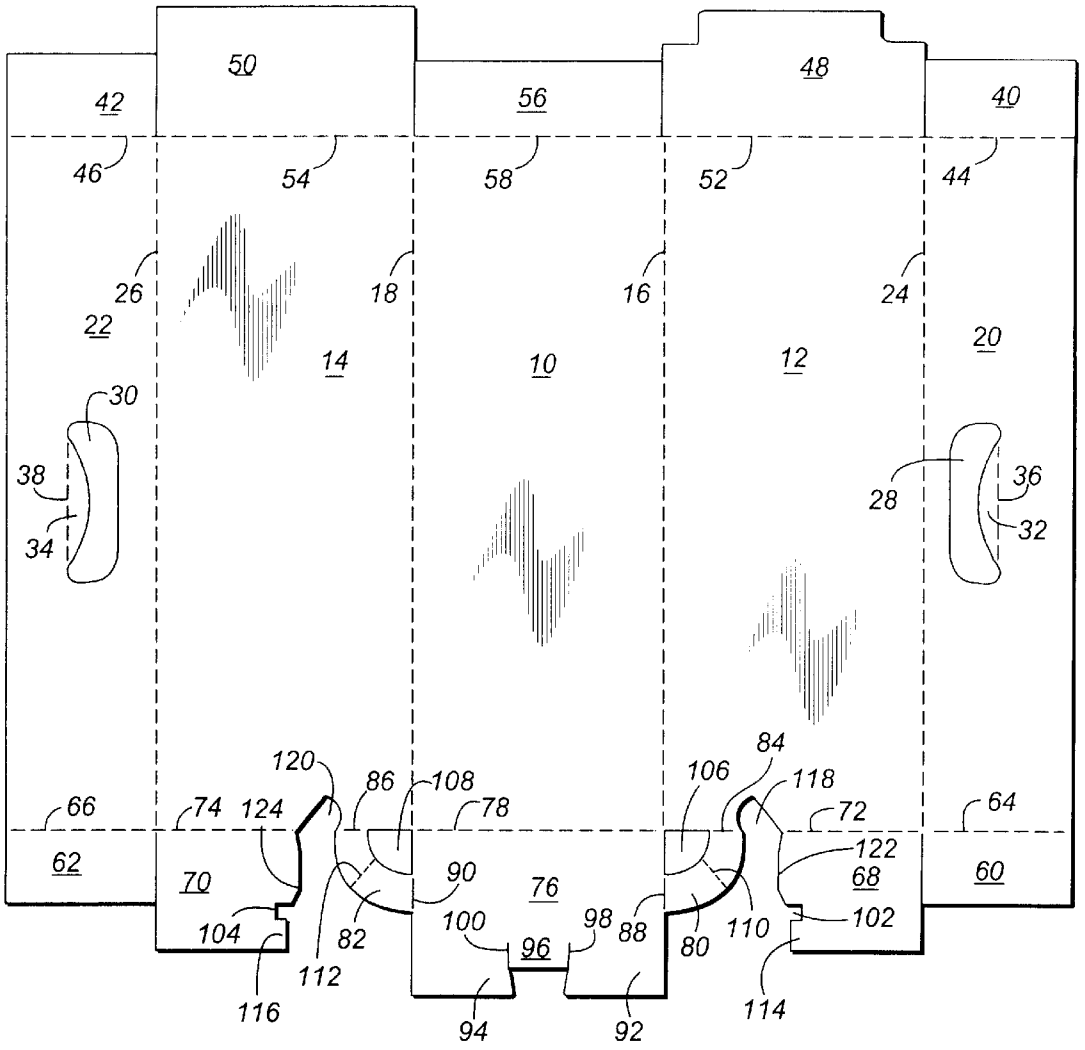
FIG. 1 is a plan view of a blank from which a carton according to the invention is formed.

According to the invention, the cans and bottles described above are packaged in a fully enclosed carton that is illustrated in blank form in FIG. 1. The blank is formed from a foldable sheet material, such as paperboard. The numeral 10 designates the bottom panel of the carton. The blank has a bottom panel 10, side panels 12, 14, and top flaps 20, 22. The bottom panel 10 is bounded by the side panels 12, 14, a closed end flap and an exiting end flap. Side panels 12 and 14 are foldably joined to the sides of the bottom panel 10 along fold lines 16 and 18, respectively. Each side panel 12, 14 has a lower edge, an upper edge, a closed end, and an exiting end.

Preferably, upon foldable construction, the top of the carton is formed by a combination of top flaps 20 and 22 that are foldably joined, respectively, to the upper edges of side panels 12 and 14, along fold lines 24 and 26. Each top flap 20, 22 has a side edge adjacent fold lines 24 and 26, respectively, a closed end and an exiting end. Alternatively, the top of the carton can be formed by a single top flap extending from one of the side panels.

Carrying means to facilitate the carrying of the carton are provided, and are formed by hand carrying apertures 28 and 30 that are struck from top flaps 20 and 22, respectively. In addition, cushioning flaps 32 and 34 are provided for the comfort a person's hands, and are foldably joined, respectively, to top flaps 20 and 22 along fold lines 36 and 38.

It will be understood by those skilled in the art that the carton of the present invention is generally symmetrical about a horizontal line of bi-section, as viewed when FIG. 1 is rotated lengthwise. This symmetry aids in the efficient production of the present carton.

When the blank is folded and glued, the resulting carton has a closed end and an exiting end. The containers exit the carton through the exiting end of the carton. The closed end of the carton preferably is assembled from top closed end flaps 40 and 42 foldably joined to the closed ends of the top flaps 20 and 22, respectively, by fold lines 44 and 46. Side closed end flaps 48 and 50 are respectively joined to the closed ends of the side panels 12 and 14 by fold lines 52 and 54. A bottom closed end flap 56 is joined to the closed end of the bottom panel 10 by fold line 58.

Alternatively, the closed end of the carton may be formed of only a single closed end flap extending from the closed end of a single panel. The closed end can also be formed of more than one closed end flap extending from more than one panel.

The exiting end of the carton has a similar closure structure to the closed end except for the provision of a dispenser. Top exiting end flaps 60 and 62 are attached to the exiting ends of the top flaps 20 and 22 by fold lines 64 and 66, respectively. Side exiting end flaps 68 and 70 are attached to the exiting ends of the side panels 12 and 14 by fold lines 72 and 74, respectively. Dispensing flap 76 is attached to the exiting end of bottom panel 10 by fold line 78. Alternatively, one or more exiting end flaps may extend from one or more side and top panels, which exiting end flap(s) in combination with the dispensing flap 76 would form the exiting end of the carton.

The dispensing flap 76 is attached at its sides to the side panels 12, 14 by gusset straps 80 and 82, which are foldably attached at one end to portions of the exiting ends of side panels 12 and 14 along fold lines 84 and 86, respectively. Gusset straps 80 and 82 are attached at the other end to portions of the sides of dispensing flap 76 along fold lines 88 and 90, respectively.

Gusset straps 80 and 82 aid in maintaining the integrity of the carton when closed and also during opening and closing of the dispensing flap 76. This carton with a dispenser is frequently placed on a refrigerator shelf with the exiting end of the carton near the end of a shelf. When the dispensing flap 76 is pulled opened, the gusset straps 80 and 82 serve to prevent the dispensing flap 76 from tilting below the plane of the refrigerator shelf, which could result in a container tumbling off of the end of the dispensing flap 76. The gusset straps 80 and 82 also serve to keep an exiting container from falling off the sides of the dispensing flap 76 as it is being removed from the carton. It should be realized that a satisfactory dispenser can be constructed without using gusset straps although they are clearly preferred for the above reasons.

Dispensing flap 76 is provided with dispensing locking tabs 92 and 94. A dispensing holding tab 96 is formed by side slits 98 and 100. Side exiting end flaps 68 and 70 are provided with holding apertures 102 and 104, respectively. Side exiting end flaps 68 and 70 are also provided with holding locks 114 and 116, respectively.

Gusset straps 80 and 82 are provided with gusset relief apertures 106 and 108, respectively, to facilitate the folding and unfolding of dispensing flap 76 about fold line 78, and the folding of gusset straps 80 and 82. Fold lines 110 and 112 may be provided in gusset panels 80 and 82, respectively, to further facilitate folding.

In order to form the top of the carton from the blank shown in FIG. 1, it is simply necessary to glue top flaps 20 and 22 together in a slightly overlapping position. The amount of overlap is determined by the difference in widths between the bottom panel 10, and the combination of widths of top flaps 20, 22. In order to form the preferable rectangular carton of the present assembly, the bottom and top of the carton should have equal widths. Thus, preferably, the combined widths of top panels 20, 22 is greater than the width of bottom panel 10, so the top panels 20, 22 must be overlapped and glued to form the top of the rectangular carton.

To form the closed end of the carton, top closed end flaps 40, 42, side closed end flaps 48 and 50 and bottom closed end flap 56 can be folded inwardly and glued. It should be realized that these panels could be provided with locks and locking apertures in lieu of the use of glue to secure the closed end of the carton. Should the closed end of the carton comprise one or more closed end flaps, the closed end flap(s) should be secured to one or more closed ends of the panels so as to form the closed end of the carton.

The carton can then be filled with cans or bottles after the closed end is secured. The configuration of the carton with the exiting end open is shown in FIG. 2. The carton can be filled with cans or bottles through the exiting end, with the bottom of each can or bottle resting on one of the side walls of the carton 12 or 14 so that the cylindrical surface of the can or bottle can easily roll on the dispensing flap 76 when it is extended. This exiting end of the carton is first partially closed by folding top exiting end flaps 60 and 62 inwardly into the carton. Dispensing flap 76 is then folded inwardly with gusset straps 80 and 82 folding inwardly, facilitated by fold lines 110 and 112, respectively. Side exiting end flaps 68 and 70 are then folded inwardly and glued in an overlapping position with dispensing locking tabs 92 and 94 being located inside of side exiting end flaps 68 and 70.

Figure 3:
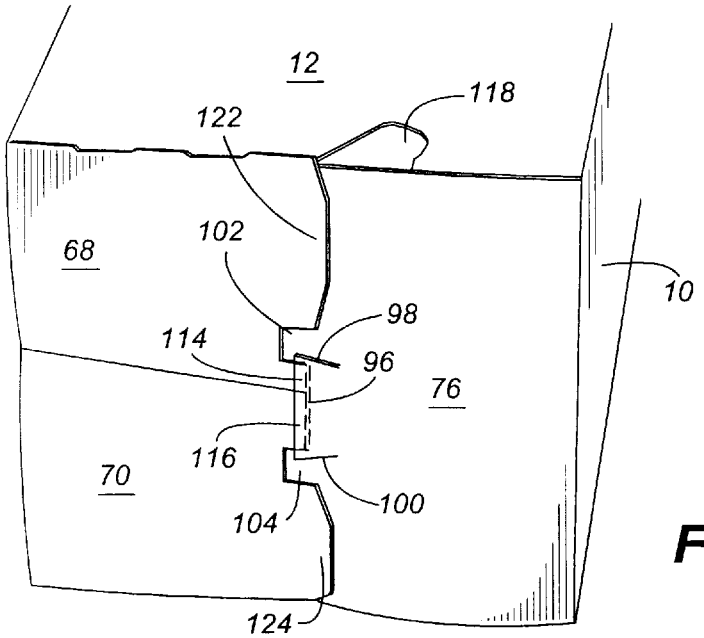
FIG. 3 is a perspective end view of the carton with PET bottles contained therein.

As shown in FIG. 3, the dispensing holding tab 96 is placed on the outside of side exiting end flaps 68 and 70, wherein holding apertures 102 and 104 facilitate this arrangement. Alternatively, dispensing holding tab 96 can be held in a closed position by tucking behind holding locks 114 and 116 in side exiting end flaps 68 and 70, respectively.

The carton is normally closed in this way once it has been opened. This results in locking tabs 92 and 94 being located on the outside of the carton when reclosed (i.e., outside of side exiting end flaps 68 and 70). It will be appreciated that the dispensing flap 76 is held in a closed position by an engaging relationship between the dispensing locking tabs 92 and 94 and the holding apertures 102, 104 and the holding locks 114, 116.

Figure 4:
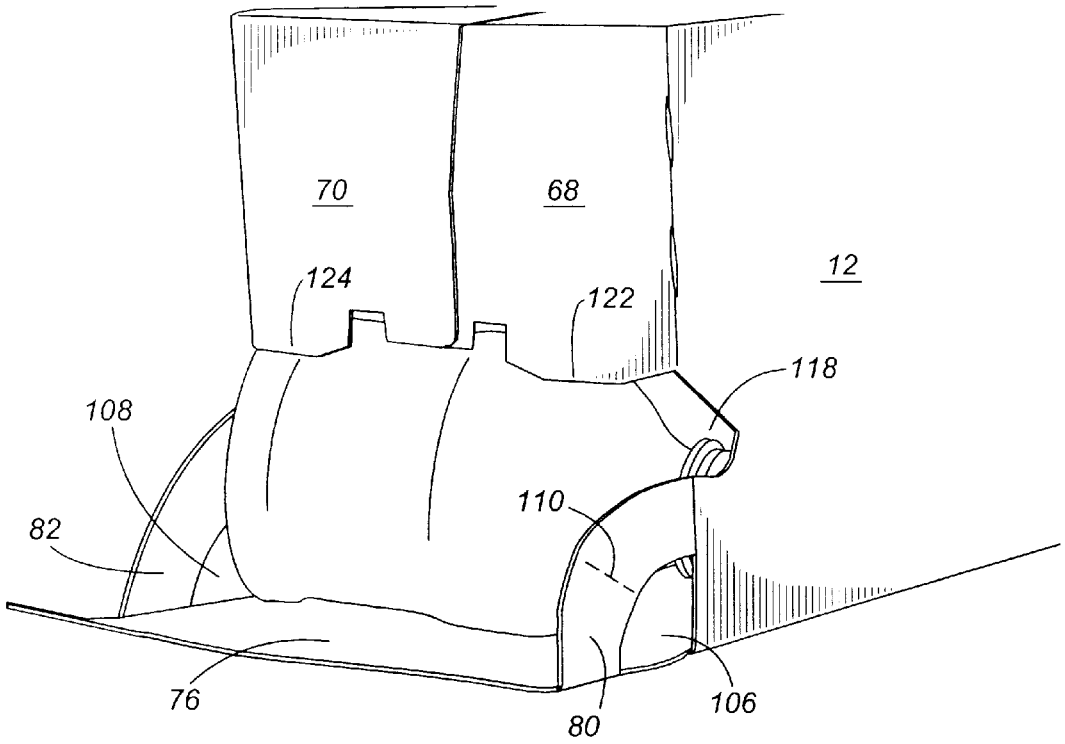
FIG. 4 is a perspective end view of the carton containing PET bottles with the dispenser opened.

In order to utilize the dispensing function according to this invention, it is simply necessary to unlock the dispensing locking tabs 92 and 94, and move dispensing flap 76 outward from the container. The carton of FIG. 4 is configured to dispense the contained bottles. No tearing of the paperboard is necessary to accomplish this, unlike in the case of most other dispensers. Finger apertures 118 and 120 can be provided for moving the exiting can or bottle out onto the dispensing flap 76. After a can or bottle has been removed, dispensing flap 76 can be closed again by engaging dispensing holding tab 96 as described above, which can be readily engaged and disengaged a number of times. The exiting can or bottle can be removed by simply grasping the ends of the can or bottle through finger apertures 118 and 120 and moving it out, which itself will facilitate the unlocking of dispensing flap 76.

Accidental discharge of cans or bottles is prevented by locking dispensing flap 76 in the closed position by tucking dispensing holding tab 96 underneath side exiting end flaps 68 and 70.

While the vertical height of dispensing flap 76 must be at least as great as the diameter of the exiting can or bottle, restraining means are needed for restraining the enclosed cans or bottles from freely rolling out of the carton when the dispenser flap 76 is lowered. Side exiting end flaps 68 and 70 are provided with container restraining flaps 122 and 124 that extend downwardly (when the exiting end of the carton is foldably assembled) so that the opening between the inside edge of the dispensing flap 76 when it as been lowered and the container restraining flaps 122 and 124, is slightly less than the diameter of a can or bottle. In this way, cans or bottles cannot spill out or discharge by gravity when the dispensing flap 76 is opened.

It will be seen that upon a manual grasp of the exiting can or bottle on its ends, followed by a slight pull forward, the exiting can or bottle can be readily withdrawn from the carton past the container retaining flaps 122 and 124.

The dispenser of this invention can be used for both cans and other types of cylindrical containers. It is particularly useful for PET bottles having a stubby configuration as illustrated in FIG. 2.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. An enclosed carton for carrying a plurality of containers, the carton having a closed end and an exiting end capable of permitting a container to exit the carton and subsequently being closed, the carton comprising:

(a) a bottom panel having side edges, a closed end and an exiting end;

(b) a pair of side walls, each side wall having a lower edge, an upper edge, a closed end and an exiting end, the lower edge of said side wall being foldably connected to a side edge of said bottom panel, each side wall extending upwardly from said lower edge to said upper edge;

(c) a top having side edges foldably joined respectively to the upper edges of said side walls;

(d) at least one closing end flap capable of closing the closed end of the carton;

(e) a dispensing flap having an outer edge connected by two side edges to an inner edge, said dispensing flap foldably joined at its inner edge to the exiting end of the bottom panel, said dispensing flap being foldably connected at its side edges to the exiting end of the side walls by gusset straps; and (f) a pair of end panels having inner edges joined at the exiting end of the upper portion of the side walls at the exiting end of the carton;

said dispensing flap and end panels being configured so that the outer edge of the dispensing flap is partially tucked behind the end panels when the carton is closed.

2. The carton of claim 1, wherein said top comprises:

(a) a pair of top panels, each said top panel having a side, a closed end and an exiting end, each said top panel foldably connected to said upper edge of a said side wall along a said side of said top panel; and (b) attaching means for attaching said top panels together.

3. The carton of claim 2, wherein said attaching means for attaching said top panels together is by overlapping said top panels and securing them together by glue.

4. The carton of claim 1 for carrying a plurality of cylindrical containers each having a diameter, wherein said at least one exiting end panel is configured so that a portion extends downwardly so that the distance between the bottom-most edge of said at least one exiting end panel and said inner edge of said dispensing flap is at least slightly less than the diameter of the containers, so as to hold a container adjacent to said dispensing flap within the carton when the dispensing flap is in the open position.

5. The carton of claim 4, wherein said dispensing flap has a holding tab recessed in said outer edge of said dispensing flap for engaging a holding lock formed in the bottommost edge of said at least one said exiting end panel, said holding tab and holding lock being configured so that said dispensing flap can be closed and held in the closed position after being opened.

6. The carton of claim 1, wherein each said side wall further has a finger aperture near said exiting end of the carton to permit a person to grasp the ends of the container adjacent said dispenser flap to facilitate its removal from the carton.

7. Dispensing means for a carton for carrying a plurality of containers, wherein said carton includes:

(a) a bottom panel;

(b) a pair of side walls; and (c) a pair end panels for closing each end of the carton;

wherein said dispensing means is formed in one end of the carton with the dispensing means comprising a dispensing flap having an inner edge, the dispensing flap foldably joined at its inner edge to an end of the bottom panel, the pair of end panels at said one end of the carton foldably joined at their inner edges to the end edges of the upper portion of the side walls, said dispensing flap further having an outer edge connected by two side edges to its inner edge, said dispensing flap being foldably connected at its side edges to the end edges of the side walls by gusset straps, said dispensing flap and end panels being configured so that the outer edge of the dispensing flap is partially tucked behind the end panels when the carton is closed.

8. The dispensing means of claim 7 for dispensing at least one cylindrical container with a diameter, wherein the end panels are configured so that a portion of the end panels extend downwardly so that the distance between the edge of the downward portion and the inner edge of the dispensing flap is at least slightly less than the diameter of the containers so as to hold the container adjacent to the dispensing flap within the carton when the dispensing flap is in the open position.

9. The dispensing means of claim 7, wherein the dispensing flap has a holding tab recessed in the outer edge of the dispensing flap for engaging a holding lock formed in the bottom edge of the end panels, said holding tab and holding lock being configured so that the dispensing flap can be closed and held in the closed position after being opened.

10. A dispenser for a carton for carrying a plurality of containers, wherein said carton includes:

(a) a bottom panel;

(b) a pair of side walls; and (c) a pair end panels for closing each end of the carton; wherein said dispenser is formed in one end of the carton with the dispenser comprising a dispensing flap having an inner edge, the dispensing flap foldably joined at its inner edge to an end of the bottom panel, the pair of end panels at said one end of the carton foldably joined at their inner edges to the end edges of the upper portion of the side walls, said dispensing flap further having an outer edge connected by two side edges to its inner edge, said dispensing flap being foldably connected at its side edges to the end edges of the side walls by gusset straps, said dispensing flap and end panels being configured so that the outer edge of the dispensing flap is partially tucked behind the end panels when the carton is closed.

11. The dispenser of claim 10 for dispensing at least one cylindrical container with a diameter, wherein the end panels are configured so that a portion of the end panels extend downwardly so that the distance between the edge of the downward portion and the inner edge of the dispensing flap is at least slightly less than the diameter of the containers so as to hold the container adjacent to the dispensing flap within the carton when the dispensing flap is in the open position.

12. The dispenser of claim 10, wherein the dispensing flap has a holding tab recessed in the outer edge of the dispensing flap for engaging a holding lock formed in the bottom edge of the end panels, said holding tab and holding lock being configured so that the dispensing flap can be closed and held in the closed position after being opened.

* * * * *